United States Patent [19]

Watts

[11] 4,382,311

[45] May 10, 1983

[54] DOOR-CLOSURE APPARATUS

[76] Inventor: John R. Watts, 8 Palmer St., South Melbourne, Australia, 3186

[21] Appl. No.: 208,676

[22] Filed: Nov. 20, 1980

[51] Int. Cl.[3] ..... E05F 3/10

[52] U.S. Cl. ..... 16/66; 16/72; 16/84

[58] Field of Search ..... 16/66, 72, 84, 74, DIG. 9

[56] References Cited

U.S. PATENT DOCUMENTS

| | | | |
|---|---|---|---|
| 3,090,988 | 5/1963 | Truhon | 16/66 |
| 3,284,841 | 11/1966 | Patriquin | 16/66 X |
| 3,781,943 | 1/1974 | Cain | 16/66 X |

*Primary Examiner*—Paul A. Bell

*Attorney, Agent, or Firm*—Francis X. LoJacono

[57] ABSTRACT

A pneumatic door-closure apparatus comprising an elongated cylindrical housing in which an integrally formed rod and piston are slidably biased, the rod having a free end that extends outwardly therefrom and including a plurality of transversely disposed grooves to receive an adjustable-retainer clamp, so as to regulate the inward longitudinal movement of the piston. The rear closed end of the housing is provided with an air-valve regulator to control the speed of the inward movement of the piston, the piston including an air-flow control to allow air to pass freely from the spring-biased side of the piston to the compressed-air side, when the rod is extended outwardly from the housing. A two-way-mounting bracket is further provided and arranged to be attached at the rear closed end of the cylindrical housing for right or left hand mounting of the apparatus.

7 Claims, 14 Drawing Figures

DOOR-CLOSURE APPARATUS

BACKGROUND OF THE INVENTION

1. Field of the Invention

This invention relates to automatic door closures, and more particularly to pneumatic door closures as used in domestic applications on screen and entrance doors.

2. Description of the Prior Art

It is well known in the art that various problems and difficulties are being encountered in providing suitable means for automatically closing doors, particularly those devices that are operated pneumatically.

Various types of closure devices have been tried and used, but very often they include features that restrict their use, and are constructed so as to be complicated to mount and operate, as well as expensive to maintain.

It has further been found in practice that the commonly used aluminum closures are difficult to adjust and set at given points of extension. This difficulty is generally caused by the lack of a properly designed control-washer device provided for this purpose. The aluminum closures are thus easily damaged and rendered defective by improper striking on the side of the tubular unit housing.

Further, quality in production and function is uncertain as a result of difficulty in maintaining the bore tolerances in the extrusion from which the cylindrical tube is manufactured.

SUMMARY OF THE INVENTION

It is an objective of this invention to overcome the above-mentioned deficiencies, and this is accomplished in the following manner.

There is provided a cylindrically shaped pump or piston-like device, as is the case for commonly used door closures. The invention employs an integrally molded rod and piston with accommodations for an air-flow-control "O" ring which is slidably received in an elongated tubular housing having a rear closed end that is provided with an air-control valve which regulates the rate of compressed air being discharged from the housing, in order to allow for proper retracting of the rod and the piston.

There is further provided a bracket for attaching the device to a structure, part of the attaching bracket being formed adjacent the rear closed end of the tubular housing. An internal-compression spring, in application, exerts a force that causes the rod to retract into the housing, thus reducing the distance between the closure points of attachment.

The rod which extends outwardly from the open end of the tubular housing includes a plurality of transversely disposed grooves to adjustably receive a retainer clamp adapted to be removably secured in a pair of selected grooves, so as to determine the specific inward longitudinal movement of the piston and the rod. The open end of the housing includes a collar having an annular recess to receive and secure a retainer clamp in locked position.

It is, therefore, an important object of the present device to provide an apparatus of this character that includes a simple yet positive means for restraining the inward longitudinal movement of the rod and the piston.

It is another object of the invention to provide a closure of this type wherein an air-flow control is incorporated within the piston, to allow free flow of air in only one direction.

Another object of the invention is to provide an apparatus of this character that includes a bracket device that allows a simple single attachment to a structure, wherein the closure unit can be attached for either right or left hand positioning.

Still another object of the invention is to provide a pneumatic door closure of this type that includes a positive air-pressure-release valve that is easily adjustable.

It is still another object of the invention to provide a door closure of this character that has relatively few operating parts.

It is a further object of the invention to provide a closure apparatus that is easy to install and to maintain.

Still a further object of the present invention is to provide a door closure apparatus that is relatively inexpensive to manufacture, and that is simple and rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
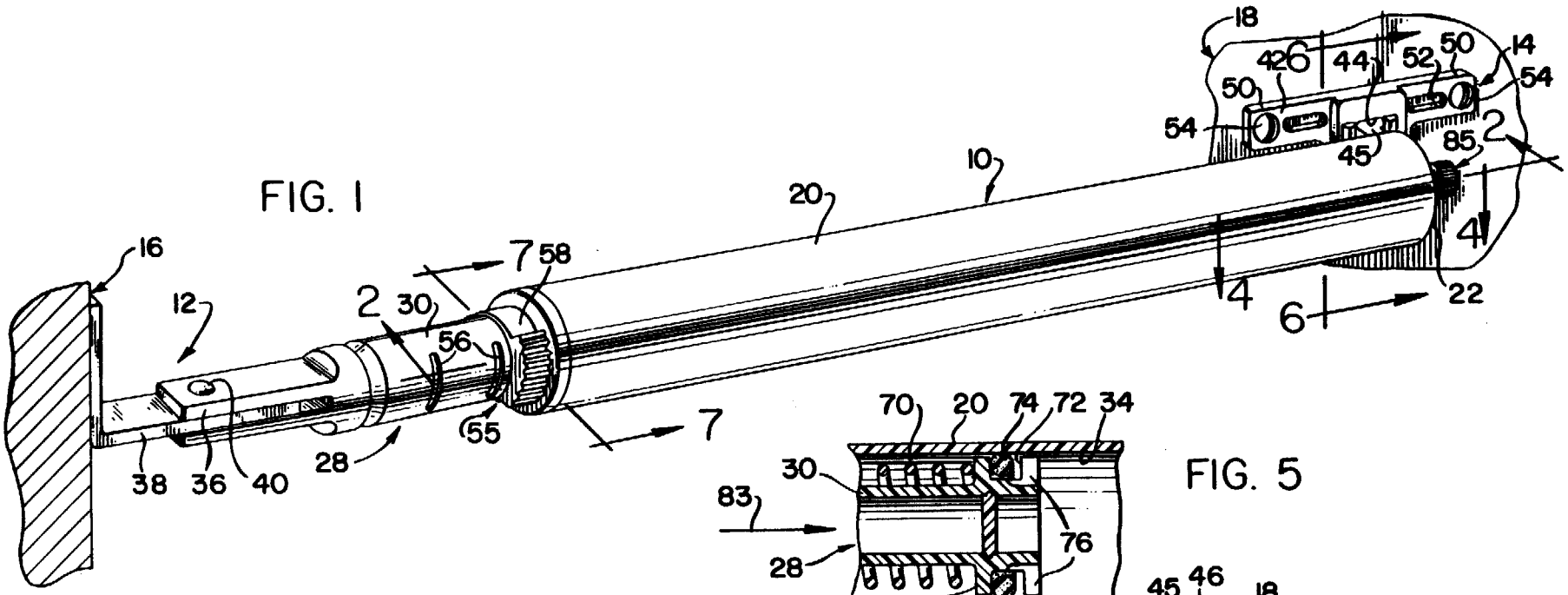
FIG. 1 is a pictorial view of the present door-closure apparatus attached between a movable door and a fixed structure.

Referring more particularly to FIG. 1, there is shown a pneumatic door-closure apparatus, generally indicated at 10, being pivotally attached at each end thereof by attaching means designated at 12 and 14, respectively. Thus, the apparatus 10 is typically interconnecting two structures 16 and 18, wherein one of the structures is fixed while the other structure represents a door, the controlled closing thereof being provided by the present invention.

Accordingly, the present invention comprises an elongated cylindrical housing 20 having a closed end 22 (which will also be referred to as the rear portion of the housing) and an open front end 24, front end 24 being provided with a collar 26 to allow the piston means, indicated generally at 28, to longitudinally slide inwardly and outwardly of housing 20. Piston means 28 comprises an elongated rod member 30 having a piston 32 integrally formed therewith, wherein piston 32 is slidably disposed in the chamber 34 defined by housing 20. The opposite free end 35 of rod 30 includes a forked tongue 36 which, together with bracket 38 and pin 40, comprises the front attaching means 12. The rear attaching means 14 comprises a coupling bracket 42 having a slotted opening 44 adapted to receive leg member 45 which is integrally formed on part of the rear portion of housing 12. Leg member 45 is provided with a semicircular groove 46 which is arranged to be coupled to either of the rounded matching vertical edges 48. The arrangement of the oppositely disposed edges 48 allows the apparatus to be mounted in either a right-to-left or a left-to-right orientation. Coupling bracket further includes extending arms 50 having a plurality of mounting holes 52 to receive screws 54 therethrough.

The piston assembly—namely, rod 30 and piston 32—is normally positioned in a closed mode wherein rod 30 and piston 32 are retracted within chamber 34 to a predetermined distance established by a selective retainer means, generally indicated at 55. The retainer means 55 comprises a plurality of oppositely disposed grooves 56 which are equally spaced apart along rod 30, and a retainer clamp 58 having inwardly projecting rib members 60 which are arranged to engage each pair of oppositely positioned grooves 56, thereby locking the retainer clamp into a selected position along rod 30, as seen in FIG. 7.

Figures 2, 3, 7, 8, 9, 10, 11, 12, 13, 14:
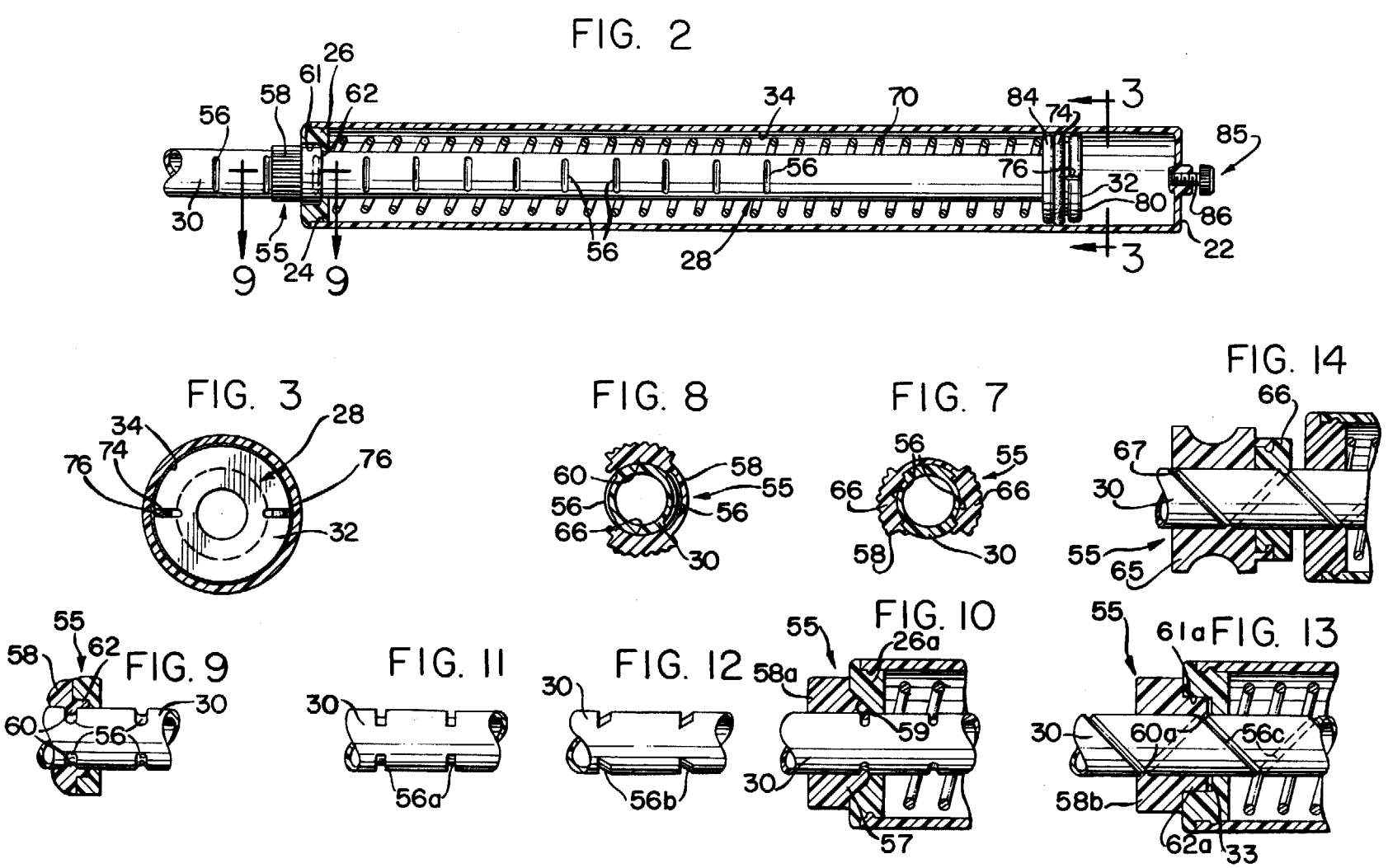
FIG. 2 is a longitudinal cross-sectional view taken substantially along line 2—2 of FIG. 1, showing the rod and piston retracted to a position established by the retainer clamp.
FIG. 3 is a cross-sectional view taken substantially along line 3—3 of FIG. 2, showing the rear of the piston having a pair of air-flow slots formed therein.
FIG. 7 is a cross-sectional view taken substantially along line 7—7 of FIG. 1, showing the restraining clamp in a locked position.
FIG. 8 is a cross-sectional view similar to FIG. 7, wherein the restraining clamp is shown in a released position.
FIG. 9 is a cross-sectional view taken along line 9—9 of FIG. 2.
FIG. 10 is a cross-sectional view showing an alternative arrangement of the restraining means.
FIG. 11 is an elevational view of a portion of a rod having grooves formed with flat sides and bottom walls.
FIG. 12 is another elevational view of a different groove configuration.
FIG. 13 is a cross-sectional view of another embodiment of the restraining means.
FIG. 14 is a cross-sectional view illustrating still another arrangement of the restraining means.

FIG. 8 shows retainer clamp 58 rotated ninety degrees to an unlocked position, thereby allowing clamp 58 to be slidably mounted to any of the paired grooves along rod 30. In order to further lock ribs 60 into grooves 56, collar 26 is provided with a recess 61 to receive the extended flange 62 of clamp 58. (See FIGS. 2 and 9.)

FIGS. 10 through 14 illustrate various alternative clamp-and-groove arrangements. FIG. 11 shows grooves 56*a* having flat side and bottom walls; and grooves 56*b* of FIG. 12 show one surface rearwardly inclined. FIG. 10 illustrates a clamp member 58*a* having beveled flanges 57 mating with beveled recesses 59 of collar 26*a*. Clamp member 58*b* in FIG. 13 includes an angularly disposed rib 60*a* which is received in a threaded-like groove 56*c*, whereby clamp 58*b* can be threadably adjusted on rod 30 to control the inward movement of rod 30 and its associated piston 32. In order to further lock clamp 58*b* in place, teeth members 63 are radially formed on the flange 62*a* and on the bottom of recess 61*a*.

The embodiment shown in FIG. 14 comprises a two-part restraining means 55 which includes a finger-grip member 65 having a rotatable clamp member 66, the rotatable clamp member 66 being adjustable along threaded groove 67.

Referring more particularly to the piston 32, there is included therein a means to control the flow of air from one side to the other—that is, a means to allow air to flow rearwardly of the piston into the space between piston 32 and rear wall 22 of chamber 34 when the rod and the piston are moved forwardly in housing 12, and to prevent air from flowing forwardly of the piston when the rod and the piston are forced rearwardly by biasing spring 70 interposed between collar 26 and piston 32.

Figure 5:
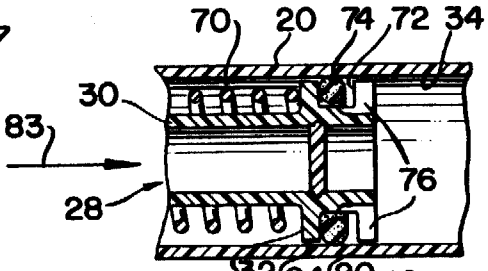
FIG. 5 is a similar cross-sectional view, illustrating the position of the air-flow-control means when the rod and the piston are moving in a rearwardly direction within the tubular housing.
Figure 4:
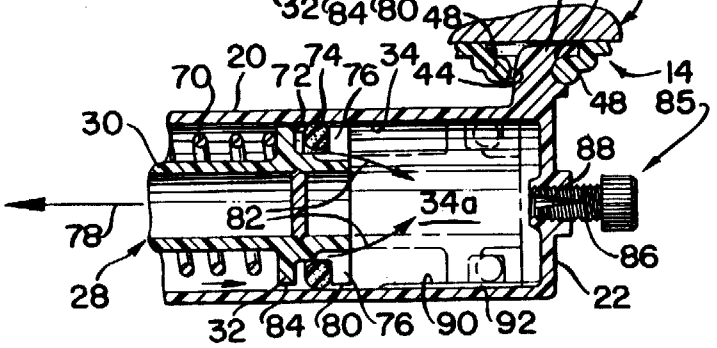
FIG. 4 is an enlarged cross-sectional view taken substantially along line 4—4 of FIG. 1, illustrating the position of the air-flow-control means when the rod is being pulled outwardly.

The air-flow-control means comprises an annular groove 72 adapted to receive an "O" ring 74 of a suitable type wherein the groove width is large enough to allow lateral movement of the "O" ring 74 as the piston is moved forwardly or rearwardly. The air-flow-control means further comprises a plurality of air vents 76 shown as a pair of slots formed in the rear of piston 28, as illustrated in FIGS. 3, 4 and 5. Referring to FIG. 4, piston means 28 is shown as being moved forwardly, as indicated by arrow 78. At this time, "O" ring 74 is positioned abutting the annular flange 80 of the piston, and engaging the inner cylindrical surface of the housing 12—thus permitting air to flow rearwardly, indicated by arrows 82, into sub-chamber 34*a* defined between piston 32 and rear wall 22. This condition generally occurs as the associated door is opened.

Thus, as the door is released, spring 70 will force piston means 28 to retract into housing 12, at which time "O" ring 74 moves to abut the forward annular flange 84 of piston 32. As seen in FIG. 5, "O" ring 74 engages both the annular flange 84 and the inner cylindrical surface of housing 12. Thus, air is prevented from passing out from sub-chamber 34*a*, whereby pressure is established within sub-chamber 34*a*.

Accordingly, in order to provide a controlled rearward retracting movement of piston means 28, as indicated by arrow 83, there is included a pressure-control-release means defined by a valve means, generally indicated at 84, which is defined by a threaded valve pin 86 having a wedge-shaped notch 88. Valve pin 86 is adjustably threaded into rear wall 22, whereby the relative position of notch 88 will control the amount of pressurized air leaking to the atmosphere. Thus, by adjusting valve pin 86, the associated door can be made to close at any desired speed.

Figure 6:
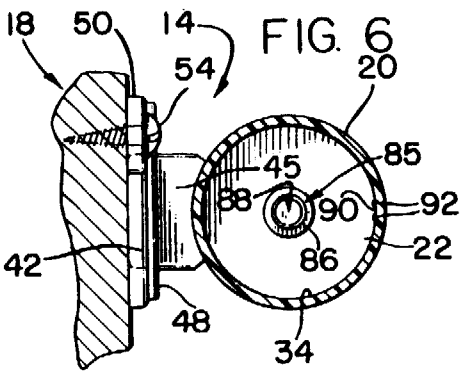
FIG. 6 is an enlarged cross-sectional view taken substantially along line 6—6 of FIG. 1.

There is also included therein a pressure-bypass means comprising a longitudinal slot or groove 90 formed in the inner surface of the cylindrical housing 12. The slot or groove 90 shown in FIGS. 4 and 6 is defined by a pair of longitudinal ribs 92 which force "O" ring 74 inwardly of flanges 80 and 84, as illustrated in FIG. 4. It should be understood, however, that a recessed slot can be formed in the surface instead of employing parallel ribs 90.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A pneumatic door-closure apparatus comprising:

an elongated tubular cylinder defining a housing having a closed end wall and an open end;

a collar member affixed within said open end of said housing;

an elongated rod slidably positioned in said housing and extending outwardly through said collar member;

a piston integrally formed with said rod at one end thereof;

a pressure chamber defined between said piston and said closed end wall of said housing;

an attaching means adapted at the opposite end of said rod;

an air-flow-control means included in said piston to allow air to flow around said piston when said rod is extended outwardly of said housing, and to compress air within said housing when said rod is retracted in said housing;

biasing means interposed between said collar and said piston, to bias said rod inwardly thereof;

a plurality of equally spaced grooves positioned transversely along said rod, wherein said grooves are formed in pairs, said pairs of grooves being oppositely disposed from each other;

a retainer clamp, including a pair of oppositely disposed rib members adapted to be engageably received in a corresponding pair of grooves, whereby said clamp can be adjustably positioned in a retracted position;

a pressure-release-valve means disposed within said closed end wall of said housing, whereby the retracting movement of said rod is controlled; and a rear attaching means formed on said housing for attaching said housing to a selected structure.

2. An apparatus as recited in claim 1, wherein said air-flow-control means comprises:

an annular groove formed in said piston;

an "O" ring adapted to be movably supported within said annular groove; and at least one radial slot formed in said piston to allow air to flow rearwardly of said piston when said rod is extended outwardly from said housing, said air flow through said radial slot being controlled by the movement of said "O" ring, and "O" ring preventing air from flowing forwardly of said piston.

3. An apparatus as recited in claim 1, wherein said pressure-bypass means comprises a longitudinal groove having a predetermined length to permit air in said pressure chamber to bypass said piston, whereby the terminating inwardly biased movement of said piston is not controlled by air pressure.

4. An apparatus as recited in claim 3, wherein said pressure-release-valve means comprises a valve pin adjustably mounted in said closed end of said housing, said valve pin having a wedge-shaped notch to allow controlled leakage of air pressure from said air-pressure chamber.

5. An apparatus as recited in claim 1, wherein said rear attaching means formed on said housing comprises:

a laterally extending leg member having a semi-circular groove formed therein; and a coupling bracket adapted to be secured to said selected structure and having a slotted opening formed therein to receive said leg member in a coupling arrangement.

6. An apparatus as recited in claim 5, wherein said attaching means of said rod comprises:

a forked-tongue member integrally formed on the end of said rod opposite from said piston; and a bracket member adapted to be secured to a selected structure and removably connected with said forked-tongue member.

7. An apparatus as recited in claim 1, wherein:

said retainer clamp includes an extended flange member, said flange member including said collar includes an annular recess adapted to receive said extended flange member therein, to lock said ribs in said grooves of said rod.

* * * * *